United States Patent [19]

Kwan

[11] 4,132,486

[45] Jan. 2, 1979

[54] RIBBON PLATFORM MECHANISM FOR EXTENDING RIBBON LIFE

[75] Inventor: Okun Kwan, Trumbull, Conn.

[73] Assignee: Bunker Ramo Corporation, Oak Brook, Ill.

[21] Appl. No.: 757,130

[22] Filed: Jan. 5, 1977

[51] Int. Cl.[2] ..... B41J 33/58

[52] U.S. Cl. ..... 400/213; 400/225

[58] Field of Search ..... 197/151, 153 R, 157, 197/158, 159

[56] References Cited

U.S. PATENT DOCUMENTS

| | | | |
|---|---|---|---|
| 662,147 | 11/1900 | Gabrielson | 197/158 |
| 2,312,314 | 3/1943 | Bordonaro | 197/158 |
| 2,557,067 | 6/1951 | Atwood | 197/153 R |
| 3,171,530 | 3/1965 | O'Daniel et al. | 197/158 X |
| 3,513,957 | 5/1970 | Ricciardi et al. | 197/151 |
| 3,613,857 | 10/1971 | Thevis et al. | 197/158 X |
| 3,782,521 | 1/1974 | Hengelhaupt | 197/158 |
| 3,871,507 | 3/1975 | Perry et al. | 197/158 X |
| 3,880,271 | 4/1975 | Hebron | 197/157 |
| 3,993,181 | 11/1976 | Potma et al. | 197/158 X |

*Primary Examiner*—Ernest T. Wright, Jr.

*Attorney, Agent, or Firm*—F. M. Arbuckle; M. Liss

[57] ABSTRACT

The present mechanism includes a vertically moving platform which raises and lowers a printing ribbon relative to the moving printhead of a printer. When the printhead is at its home position, the platform is at its raised position thereby locating the lowermost portion of the ribbon at the printhead. As the printhead starts to move during its printing cycle, the platform will progressively lower so that when the printhead is at the center of its travel, the platform will be in its lowered position, thus locating the uppermost portion of the ribbon at the printhead. As the printhead continues to the end of its travel, the platform will end up at its raised position thus locating the lowermost portion of the ribbon at the printhead. This raising and lowering of the platform presents the ribbon to the printhead in overlapping arched patterns, thereby utilizing the full width of a printing ribbon.

13 Claims, 7 Drawing Figures

RIBBON PLATFORM MECHANISM FOR EXTENDING RIBBON LIFE

FIELD OF THE INVENTION

The present invention relates to ribbon feeding mechanisms for printers and typewriters, and more particularly to such mechanisms which extend the useful life of a ribbon.

BRIEF DESCRIPTION OF THE PRIOR ART

In the present-day printers such as printers of the short stroke or dot matrix type, after each line of characters is imprinted, the ribbon is caused to increment horizontally. Generally, the ribbon is caused to move in a first horizontal direction then is reversed so that each impacted space along the ribbon provides several printed characters. Since the characters are formed in a relatively small area of the ribbon, full utilization is not made of the ribbon. Attempts have been made to increase the utilization of the ribbon so that the useful life thereof may be extended. For example, a rudimentary approach is to shift the ribbon between two vertical positions so that an upper row of characters is impacted against the ribbon during its travel in a first direction while a lower row of characters is impacted against the ribbon during a reversed direction. Although this essentially doubles the utilized area of the ribbon, there is still a substantial ribbon area that remains unutilized.

A more sophisticated approach to ribbon utilization exists in the prior art. For example, U.S. Pat. No. 2,312,314 includes a ribbon shifting mechanism which causes print characters to impact along gradually sloping paths, first upward and then downward, as the ribbon is moved horizontally. Although this approach increases ribbon utilization, there is still a substantial area of the ribbon which is not used.

U.S. Pat. No. 3,782,521 is directed to a complex ribbon lifting mechanism for a power driven typewriter. The mechanism includes a planetary gearing arrangement and interlocking linkages and camming surfaces which successively move a ribbon to slightly different vertical positions to enable slightly different portions of a ribbon to be successively struck by a type head impacting against a platen. The complexity of the mechanism set forth in this patent increases the cost of a printer or typewriter which is to include the mechanism and also decreases the reliability of such a printer or typewriter due to the inclusion of more mechanical components than is necessary.

BRIEF DESCRIPTION OF THE PRESENT INVENTION

The present invention is an improvement over the above-mentioned prior art in that it achieves substantially full utilization of ribbon area thereby substantially increasing ribbon life. A movable platform mounts the ribbon spools and a simple cam moves the platform upwardly and downwardly as a character line is printed. As a result, a printhead is caused to impact against the ribbon in overlapping arched patterns which consume substantially all of the utilizeable space on the ribbon. The present invention provides for longer ribbon life and uniform density. Since the ribbon is raised relative to a printhead, at the initiation of each arched pattern, it becomes easier for a document to be inserted.

BRIEF DESCRIPTION OF THE FIGURES

The above-mentioned objects and advantages of the present invention will be more clearly understood when considered in conjunction with the accompanying drawing, in which.

DETAILED DESCRIPTION OF THE INVENTION

Figure 1:
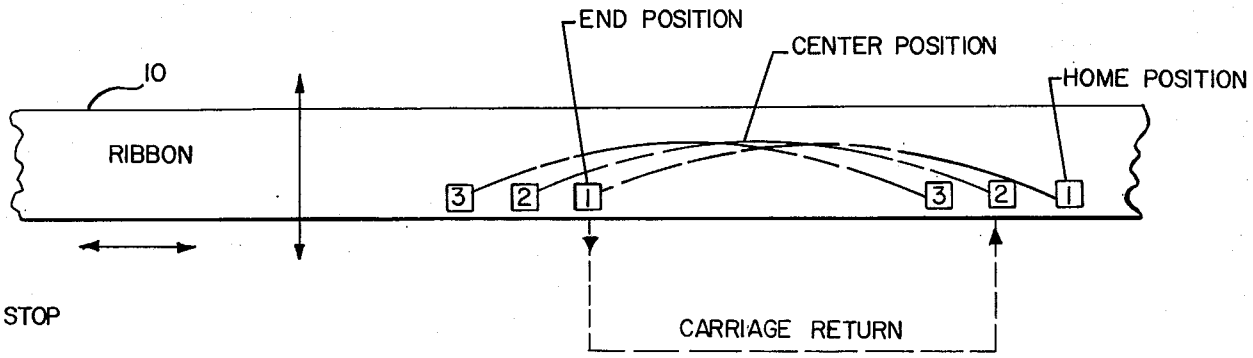
FIG. 1 is a schematic illustration depicting the overlapping arched patterns of print cycles on a ribbon.
Figure 3A:
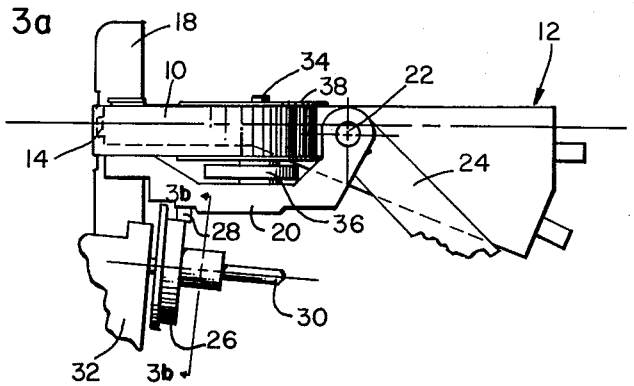
FIG. 3*a* is a view similar to that of FIG. 2*a* but illustrates the position of the ribbon platform at its lowest point.
Figure 3B:
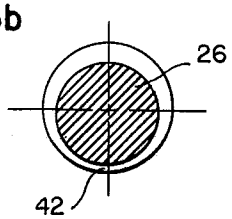
FIG. 3*b* is a figure similar to that of FIG. 2*b* taken along section line 3*b*—3*b* of FIG. 3*a* showing the cam as it appears at a low point.

Referring to the figures and more particularly FIG. 1, reference numeral 10 refers to a length of ribbon that is to move vertically upward and downward as it is moved horizontally, relative to a printhead 12 so that arcuate overlapping printing patterns of impacted type are created. For example, the first illustrated arcuate pattern is indicated by reference numeral 1 and is shown to begin with a home position toward the lower edge of the ribbon 10. Slowly, pattern 1 swings upwardly and to the left until a high point is achieved toward the upper edge of the ribbon 10. This is indicated as the center position of the first pattern 1. As the ribbon 10 continues to move horizontally to the right, the pattern 1 of impacting will change so that the arc swings downwardly again toward the lower edge of ribbon 10. As a result, a first cycle of printing occurs whereat an arched printing pattern 1 is effected. It is to be pointed out that the printhead 12 actually moves between the home position, center position and end position of the first cycle or pattern 1. During this time when the printhead 12 travels across the ribbon 10, the ribbon 10 only moves vertically relative to the printhead 12, but does not move horizontally. After the printhead 12 has printed a line and comes to the end position, relative to the ribbon 10, a ribbon moving mechanism is actuated, as will be explained hereinafter, so that the printhead 12 now is located at the home position of printing cycle 2. Again, the printhead 12 is moved from right to left across a section of the ribbon 10 so that the printhead 12 moves from home position to center position and finally end position of the second print cycle 2. In the illustration of FIG. 1, a third cycle 3 is also shown. Of course, the printing cycles go on indefinitely so that a pattern of overlapping arcuate cycles occurs along the length of the ribbon 10. After each successive attainment of an end position, the printhead 12 is returned to a home position to initiate a new cycle.

Figure 2A:
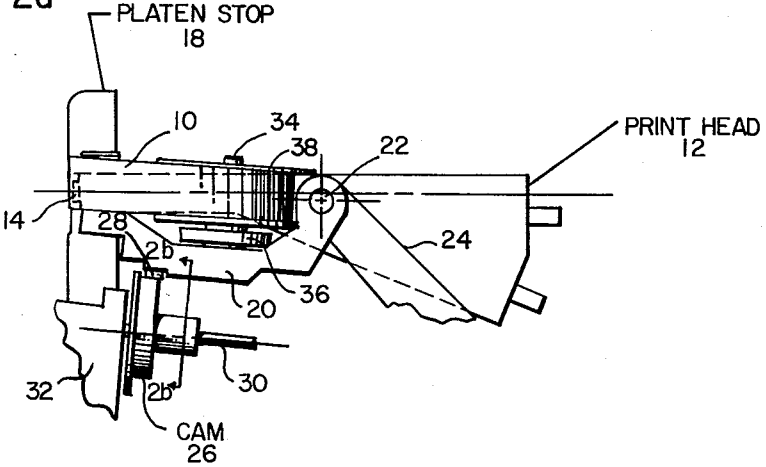
FIG. 2*a* is a side elevational view of the ribbon mechanism when the supporting ribbon platform is at its highest point.
Figure 2B:
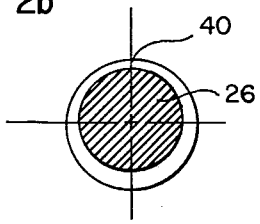
FIG. 2*b* is a partial sectional view taken along section line 2*b*—2*b* of FIG. 2*a* illustrating the driving cam at its high point, relative to the ribbon platform.

FIG. 2*a* illustrates the components necessary to achieve the vertical displacement of a ribbon 10 during horizontal movement of a printhead 12. The printhead 12 has its printing elements at 14 in proximity with a printing plane against which a document is positioned during a printing operation. As is the case with most dot matrix printers, used herein for illustrative purposes, a platen stop 18 is provided to ensure that a document (not shown) is properly positioned in the print plane. A ribbon platform 20 supports the ribbon 10 and moves the ribbon 10 vertically due to the pivotal connection of the ribbon platform 20 at pivot point 22. The ribbon platform 20 and the pivot point 22 are supported by support members 24, which may be positioned at opposite ends of the ribbon platform 20.

The means for vertically displacing the ribbon platform 20 is an eccentrically mounted cam 26 which has a camming surface in engagement with a cam follower 28, the latter being attached to the underside of the ribbon platform 20. The cam 26 is secured to a shaft 30 which is driven by a motor (not shown) during scanning motion of the printhead 12. An opposite end of the shaft 30 is journalled within block 32.

The ribbon carrying components are conventional. They include a spindle 34 which mounts a spool of ribbon 38. On the underside of the spool 38 and coaxial with the spindle 34 is a ratchet gear 36 which increments the horizontal motion of ribbon 10. As is shown in FIGS. 4 and 5 and included in conventional printers of this type, two such spindles 34 and 56, spools 38 and 55 and ratchet gears 36 and 54 are included at opposite ends of a length of ribbon 10 across which the printhead 12 scans.

FIG. *2b*, taken along section line *2b* of FIG. *2a*, illustrates the high point position of cam 26, the high point being indicated at reference numeral 40. When the cam 26 is in this position, the ribbon platform 20 and the ribbon components mounted thereabove are shown in the elevated position of FIG. *2a*. This will be the position of the ribbon platform 20 and cam 26 in the home and end positions previously explained in connection with FIG. 1.

FIG. *3b*, taken along section line *3b* of FIG. *3a*, illustrates the disposition of cam 26 at a low point 42. The ribbon mechanism components are shifted downwardly, relative to the printhead 12, as shown in FIG. *3a*. This is the position of the ribbon platform 20 and cam 26 when the ribbon mechanism components are in a center position as previously explained in connection with FIG. 1. Of course, other points along the camming surface will be engaged by the cam follower 28 at points between the high and low points 40 and 42, respectively, just explained.

Figure 4:
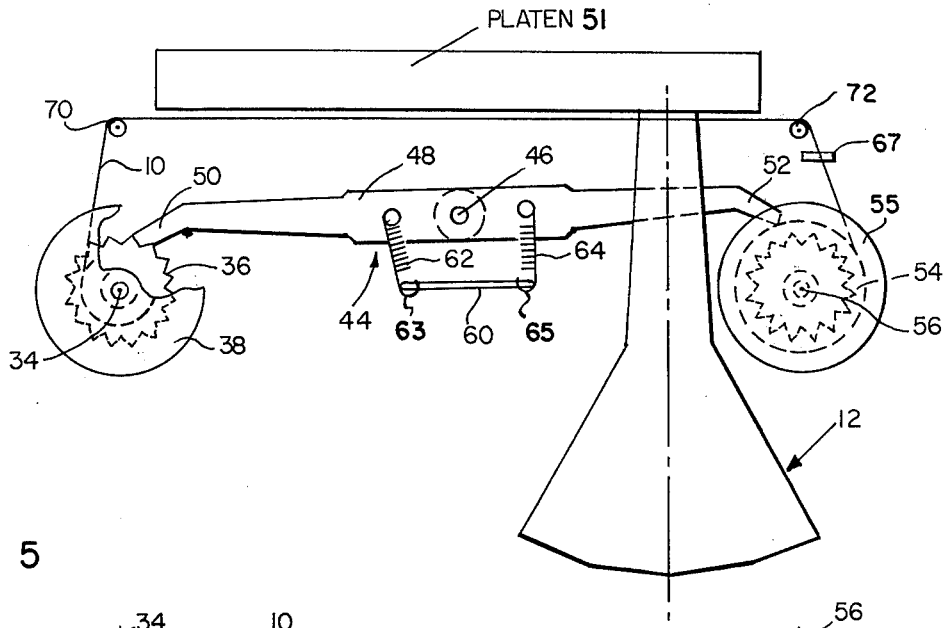
FIG. 4 is a top plan view of a ribbon advancing mechanism..
Figure 5:
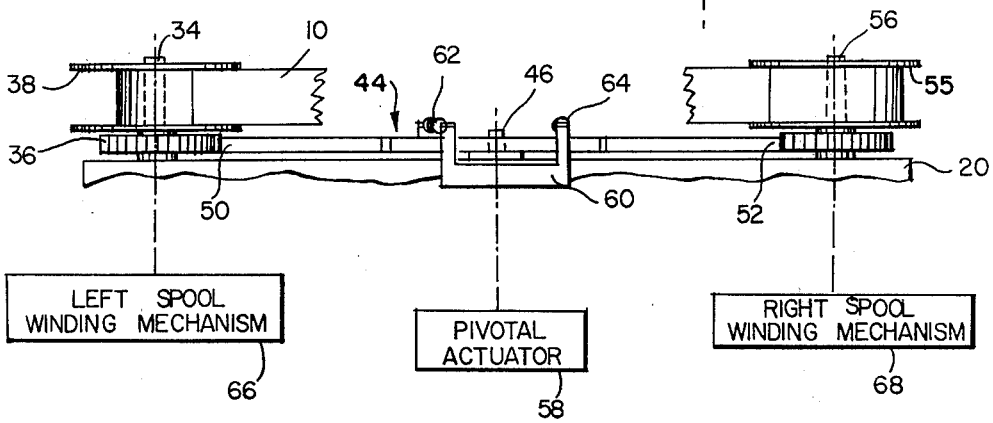
FIG. 5 is an elevational view of the mechanism shown in FIG. 4.

FIG. 4 illustrates a pawl-ratchet mechanism for advancing the ribbon 10 after each cycle which occurs at the end position of each arc pattern generated between the ribbon 10 and printhead 12 as explained in connection with FIG. 1. A bifurcated pawl is generally indicated by reference numeral 44. This pawl 44 is centrally mounted on a pivot 46. The central portion 48 of the pawl 44 extends outwardly to the left to a ratchet engaging end 50. The ribbon 10 as illustrated will remain in place between the left and right spools 38 and 55 during traversal of the printhead 12 from the home position at the right end of the platen 51 to a leftmost position. The printhead 12 will then return to a home position during which time the ribbon 10 will advance so that a second print cycle will be displaced from the first print cycle as shown and described in connection with FIG. 1. The sequential incrementing of the ribbon 10 between the spool 38 and 55 occurs as the ratchet engaging end 50 is incrementally moved between adjacent teeth of ratchet gear 36. Notice that during a presumed motion of the ribbon 10 from left to right, an opposite ratchet engaging end 52 remains clear from engaging the ratchet 54 associated with the right ribbon spool 55 which is mounted on its own spindle 56.

Referring to FIG. 5, a pivotal actuator 58, shown in block diagram form, is used to disengage ratchet engaging end 50 and ratchet gear 36 when the left end of a ribbon 10 is sensed. In order to reverse the direction of ribbon incrementation and repeat the printing cycles from an opposite direction, the pivotal actuator 58 must then engage the ratchet engaging end 52 and its associated ratchet 54. The pivotal actuator 58 does not, per se, form part of the present invention but may be made from conventional components such as solenoid-linkage components connected to the pivot 46. A support member 60 permits the connection of springs 62 and 64 between the central portion 48 of pawl 44 and left and right off-center points 63 and 65 on either side of pivot 46. These springs 62 and 64 resiliently engage the selected ratchet engaging end 50 or 52 of the pawl 44 with either ratchet 36 or 54. Winding mechanisms 66 and 68 are shown in block diagram form and indicated as being connected with the left and right spools 38 and 55, respectively. These winding mechanisms 66 and 68 may simply be stepping motors or another conventional type of electromechanical mechanism for permitting the spools 38 and 55 to turn each time a print cycle is completed. This approach is conventional.

To further round out the disclosed embodiment, the ribbon 10 is seen to be guided by rollers 70 and 72 which are positioned at opposite points along the sections of a ribbon 10 to be impacted against. A ribbon guide 67 is also included.

From an explanation of the invention, it will be appreciated that the combination of components set forth herein operate in a synergistic fashion to achieve an unusual overlapping arcuate printing pattern across a ribbon 10 which extends ribbon life and ensures uniform print density. In addition, since the ribbon 10 is raised by the platform 20 when the printhead 12 is in the home position, there is more clearance generated for document insertion.

It should be understood that the invention is not limited to the exact details of construction shown and described herein for obvious modifications will occur to persons skilled in the art.

I claim the following:

1. A ribbon mechanism, for printers having a movable printhead, which equalizes print density and extends the useful life of a ribbon, comprising:

a platform movable bidirectionally;

a length of printing ribbon extending along a third direction perpendicular to the bidirectional movement of the platform for receiving character impacts from the pinthead as the printhead traverses a section of said ribbon;

means for moving the platform bidirectionally as the printhead traverses the ribbon, and causing the printhead to effect an arcuate printing pattern across the ribbon each time the printhead traverses the ribbon length; and means cooperating with the ribbon for incrementing movement thereof, after each traversal of a ribbon length by the printhead, and causing successive printing patterns to overlap, thus utilizing substantially all of the printable area of the ribbon.

2. The subject matter set forth in claim 1 together with first and second spools spaced from each other and mounting the ribbon therebetween, the ribbon incrementing means being connected to the spools for incrementing the spools at the completion of each printing pattern.

3. The subject matter set forth in claim 2 wherein the platform moving means includes a single rotating eccentric cam for engaging and causing the ribbon platform to follow the cam in bidirectional motion.

4. The subject matter set forth in claim 2 wherein the incrementing means comprises a ratchet cooperating with at least one spool and a pawl for engaging the ratchet and preventing the spool from incrementing the ribbon until the completion of printhead traversal whereupon the pawl disengages the ratchet sufficiently to permit incrementing of the spool and ribbon.

5. The subject matter set forth in claim 3 together with means for pivotally mounting the ribbon platform at a first end thereof which permits an opposite end of the platform to execute the bidirectional motion.

6. The subject matter set forth in claim 4 wherein the printhead is a short stroke dot matrix printer.

7. A ribbon shifting mechanism for utilizing substantially all of the area of an inked ribbon, the mechanism comprising:

a movable platform for mounting two spindles which accommodate ribbon spools thereon;

a cam follower mounted on the platform;

an eccentrically driven cam contacting the cam follower and driving the platform in an upward then downward direction;

a printhead mounted separately from the platform for traversing an exposed length of ribbon in an arcuate printing pattern between a home and an end-of-travel position, during each printhead traversal;

a ratchet connected to each spool spindle;

means connected to said spindles for providing incremental indexing of said ribbon when said printhead returns to a home position, and pawl members selectively engaging the ratchets in between incremental indexing of the ribbon at the initiation of each of said printing patterns, a sequence of printing patterns resulting in overlapping arcuate patterns covering substantially all of the ribbon.

8. The subject matter set forth in claim 7 wherein the pawl members are mounted at opposite ends of a rocker arm, the pawl members selectively engaging one or the other of said ratchets during respective forward or reversed movement of the ribbon.

9. The subject matter set forth in claim 8 together with means for resiliently positioning one or the other of the pawl members in engagement with a corresponding ratchet.

10. The subject matter set forth in claim 9 wherein the printhead is of the short stroke dot matrix type.

11. A ribbon shifting mechanism for utilizing substantially all of the area of an inked ribbon, the mechanism comprising:

a movable platform for mounting two spindles which accommodate ribbon spools thereon;

a cam follower mounted on the platform;

an eccentrically driven cam contacting the cam follower and driving the platform in an upward then downward direction;

a printhead mounted separately from the platform for traversing an exposed length of ribbon in a pattern comprising uniformly closely spaced portions, each portion having a plurality of contiguous sections lying in directions transverse to the length of the ribbon, successive portions of said pattern overlapping one another;

a ratchet connected to each spool spindle;

means connected to said spindles for providing incremental indexing of said ribbon when said printhead returns to a home position; and pawl members selectively engaging the ratchets in between incremental indexing of the ribbon at the initiation of each of said portions, the pattern resulting in portions covering substantially all of the ribbon.

12. A ribbon shifting mechanism for utilizing substantially all of the area of an inked ribbon, the mecchanism comprising:

a movable platform for mounting two spindles which accommodate ribbon spools thereon;

a cam follower mounted on the platform;

an eccentrically driven cam contacting the cam follower and driving the platform in an upward then downward direction;

a printhead mounted separately from the platform for traversing an exposed length of ribbon in a printing pattern between a home and an end-of-travel position, during each printhead traversal;

a ratchet connected to each spool spindle;

means connected to said spindles for providing incremental indexing of said ribbon when said printhead returns to a home position; and pawl members selectively engaging the ratchets in between incremental indexing of the ribbon at the initiation of each of said printing patterns, a sequence of printing patterns resulting in overlapping patterns covering substantially all of the ribbon.

13. The apparatus recited in claim 12 wherein each of said printing patterns traversed by said printhead comprises components transverse to the length of the ribbon, said patterns being repeated at incremental displacements along the length of the ribbon.

* * * * *